US005604815A

United States Patent [19]

Paddock

[11] Patent Number: 5,604,815

[45] Date of Patent: Feb. 18, 1997

[54] SINGLE MAGNET AUDIO TRANSDUCER AND METHOD OF MANUFACTURING

[75] Inventor: Paul W. Paddock, McMinnville, Oreg.

[73] Assignee: Linaeum Corporation, Portland, Oreg.

[21] Appl. No.: 272,295

[22] Filed: Jul. 8, 1994

Related U.S. Application Data

[63] Continuation of Ser. No. 962,988, Oct. 15, 1992, abandoned, which is a continuation-in-part of Ser. No. 916,038, Jul. 17, 1992.

[51] Int. Cl.[6] ..... H04R 25/00

[52] U.S. Cl. ..... 381/192; 381/182; 381/194

[58] Field of Search ..... 381/202, 203, 381/204, 199, 194, 195, 192, 201, 196, 197, 182, 186

[56] References Cited

U.S. PATENT DOCUMENTS

| | | | |
|---|---|---|---|
| 3,350,513 | 10/1967 | Roberts | 381/196 |
| 4,281,223 | 7/1981 | Ugaji et al. . | |
| 4,465,906 | 8/1984 | Adolph et al. | 381/194 |
| 4,584,439 | 4/1986 | Paddock | 179/115.5 |
| 4,609,784 | 9/1986 | Miller | 381/96 |
| 4,653,103 | 3/1987 | Mori et al. . | |
| 4,803,733 | 2/1989 | Carver et al. | 381/196 |
| 4,903,308 | 2/1990 | Paddock et al. | 381/202 |
| 5,025,240 | 6/1991 | La Croix | 335/284 |
| 5,127,060 | 6/1992 | Paddock | 381/197 |

FOREIGN PATENT DOCUMENTS

| | | | |
|---|---|---|---|
| 0492142 | 7/1992 | European Pat. Off. | 381/199 |
| 1180456 | 6/1959 | France | 381/195 |
| 3001873 | 7/1981 | Germany | 381/186 |
| 52-4228 | 1/1977 | Japan . | |
| 0125798 | 9/1980 | Japan | 381/196 |
| 0101196 | 5/1986 | Japan | 381/199 |
| 0093798 | 5/1986 | Japan | 381/199 |
| 0201796 | 9/1991 | Japan | 381/199 |
| 0705100 | 3/1954 | United Kingdom | 381/195 |
| 1002128 | 8/1965 | United Kingdom | 381/199 |

OTHER PUBLICATIONS

Brochure entitled "Aurasound," Aura Systems, Inc., 2335 Alaska Avenue, El Segundo, California 90245 (1993).

*Primary Examiner*—Curtis Kuntz
*Assistant Examiner*—Huyen D. Le
*Attorney, Agent, or Firm*—Klarquist Sparkman Campbell Leigh & Whinston, LLP

[57] ABSTRACT

An audio transducer having a having a single magnet and an adjacent iron bar spaced apart to define a gap. The bar has two edges, each positioned near one pole of the magnet to define a respective field across the gap, with the fields being oppositely polarized. An electromagnetic coil is positioned to ocsillate within the gap in response to an audio signal. The transducer is assembled with an unmagnetized magnet. The magnet is magnetized after assembly by application of an external magnetic field.

8 Claims, 4 Drawing Sheets

54
56
50
16
12
S
N
52
14
20
22
24
38
40
36
30
28
32

150
28
S
N
38
40
102
36

20
36
104

10
10
74
96

64
96

FIG. 11
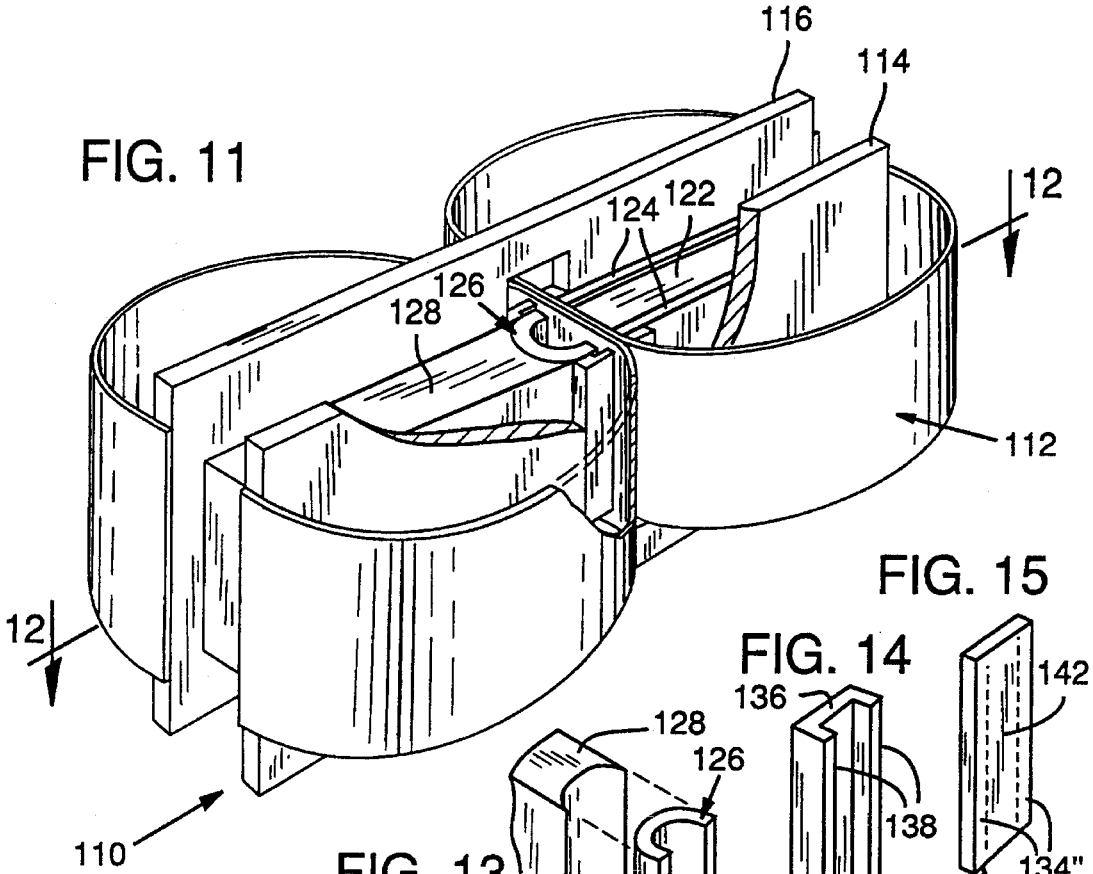
FIG. 15
FIG. 14
FIG. 13
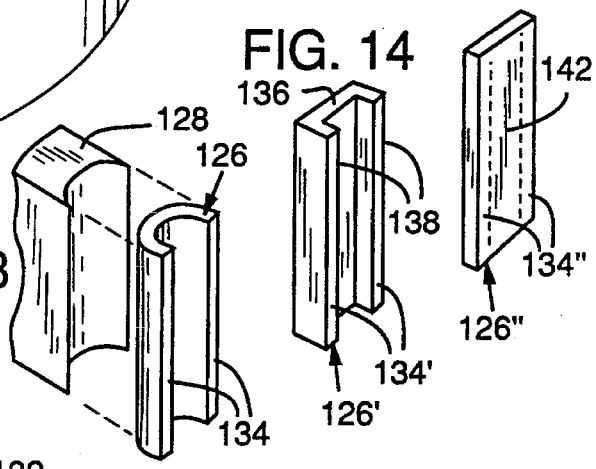
FIG. 12
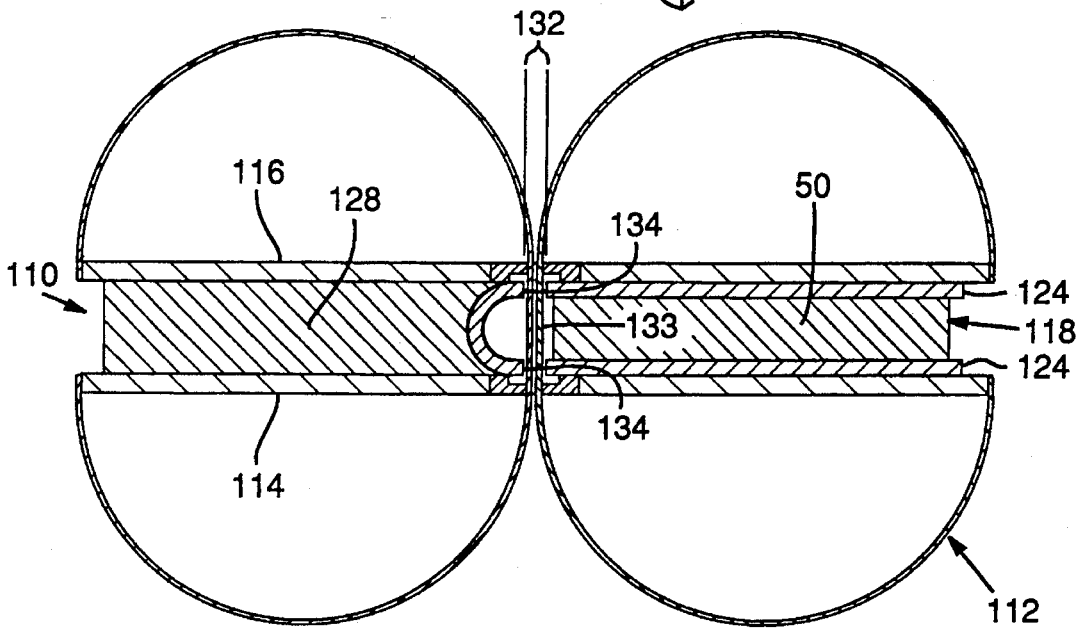

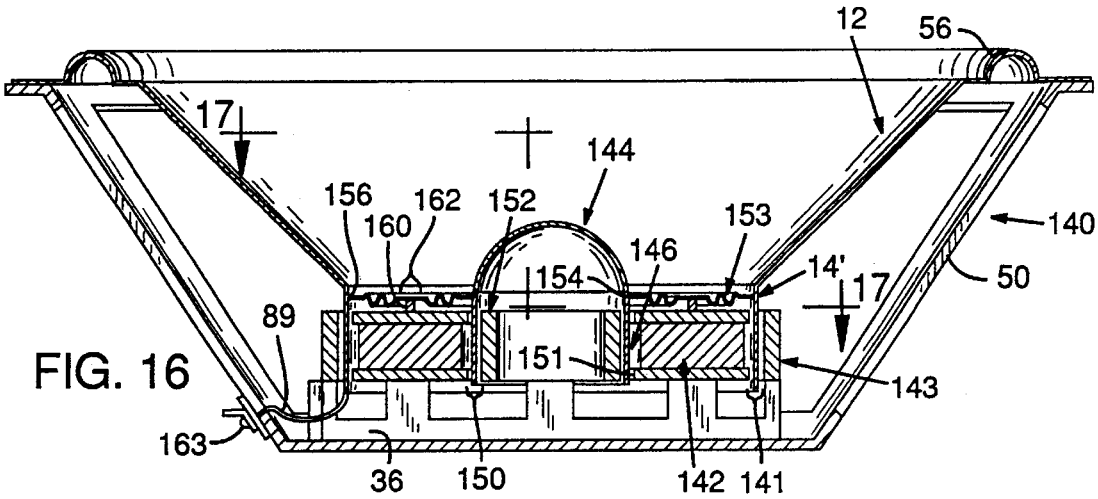
FIG. 16
FIG. 17
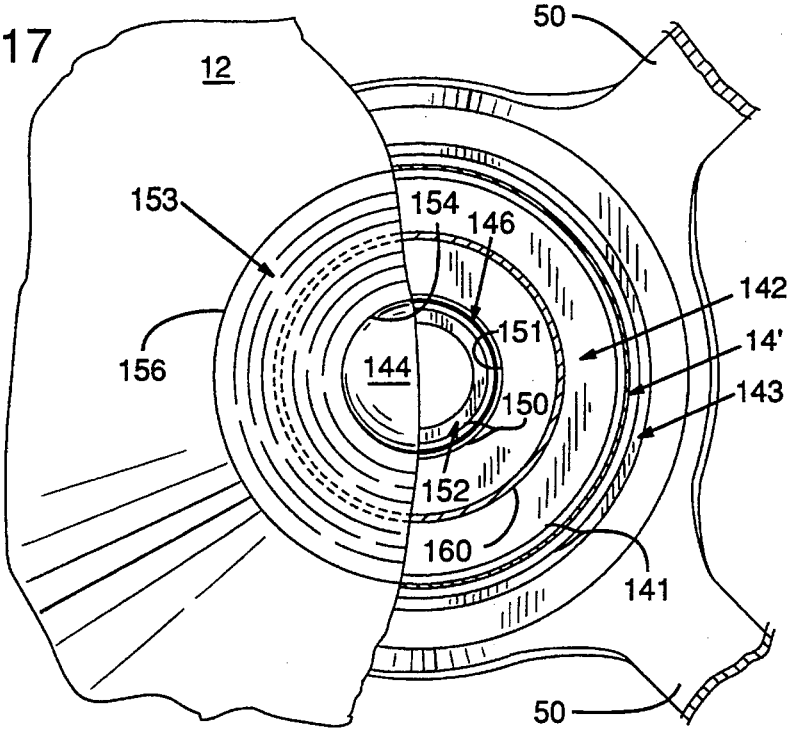
FIG. 18
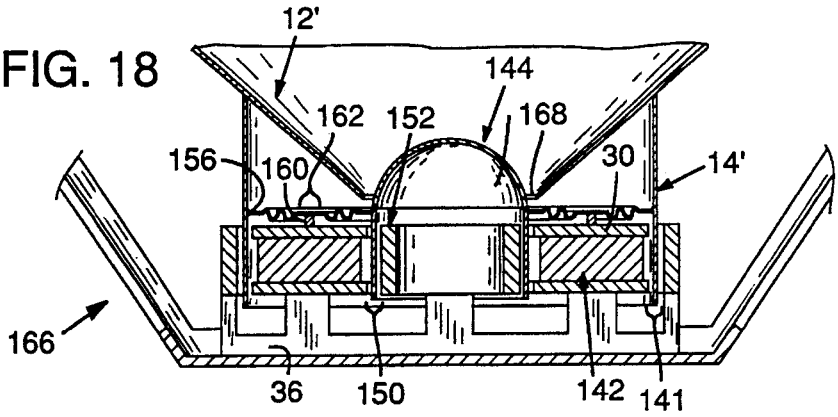

SINGLE MAGNET AUDIO TRANSDUCER AND METHOD OF MANUFACTURING

CROSS-REFERENCE TO RELATED APPLICATION

This application is a continuation of application Ser. No. 07/962,988, filed on Oct. 15, 1992, now abandoned, which is a Continuation-in-Part of co-pending application Ser. No. 07/916,038, filed Jul. 17, 1992.

TECHNICAL FIELD

This invention generally relates to audio transducers. More particularly, the invention relates to improvements in the design of a transducer having a single magnet.

BACKGROUND OF THE ART

Cylindrical voice coils are commonly used on audio transducers such as cone drivers, dome tweeters, and microphone transducers. Typically, a cylindrical voice coil is suspended in a magnetic field, physically attached to a sound-generating diaphragm, and electrically connected to a signal source. The voice coil is usually a thin-walled tube having fine wire closely wrapped about the tube in a helical pattern. Glue is applied to secure the wire. A magnet structure provides an annular gap to receive the coil, with a radial magnetic field spanning across the gap to generate axial forces on the coil as a varying signal current flows through the coil. The conventional magnet structure is formed by a doughnut magnet having a front surface at a first polarity and a rear surface at the opposite polarity. An annular pole plate is attached to the front surface; a circular pole plate is attached to the rear surface, and includes an iron plug protruding forwardly through the doughnut hole to a position flush with the front surface of the front annular pole plate. Together, the plug and the front pole plate define an annular gap for receiving the coil. Magnetic field lines extend radially across the gap, with magnetic flux moving radially in only one direction.

A wire wound coil has several disadvantages. While other components of conventional cone transducers may otherwise be manufactured and assembled using highly automated processes, coil winding is more labor and skill intensive. Winding defects readily occur, often resulting in a significant number of rejected units that might not be discovered until after the product is completely assembled. To avoid excessive defects, coil winding machinery must operate at a limited speed. One type of failure mode common in wire coils is an imperfect wrap caused by a gap or overlap between adjacent wire loops. An overlapping wire may contact the magnet structure, resulting in unacceptable performance and eventual product failure during use.

Wire coil transducers have difficulty handling heat generated in the coil. During operation, current flowing through the coil generates heat that must be dissipated to prevent the coil from reaching excessive temperatures. The round wires employed in conventional voice coils have a relatively low surface area, and are therefore inefficient radiators. More important, the adhesive required to secure the wire to the core tube is vulnerable to failure at high temperatures. This failure can result in detachment of the wire. Even without detachment, thermal stresses may cause warpage of the entire voice coil, which may also result in catastrophic failure of the device.

It is believed that extensive efforts have been made throughout the audio industry to avoid the problems of wire coils by attempting to develop a more manufacturable alternative. Attempts may have been made to create flexible circuits, form them into cylindrical tubes, and provide numerous electrical connections at the junction between the two ends of the film to provide a helical conductor. Other attempts may have been made to deposit conductive material in a helical pattern on the interior or exterior surfaces of a thin walled tube. Apparently, none of these attempts has provided a suitable substitute for conventional voice coils.

Some sophisticated audio transducers employ magnet structures having more than one magnet, with the magnets being differently polarized. Such structures are disclosed in U.S. Pat. No. 4,903,308 to Paddock et al., U.S. patent application Ser. No. 07/916,038 to Paddock, filed July 17, 1992, U.S. patent application Ser. No. 07/730,172 to Paddock, filed Jul. 12, 1991, all of which are incorporated herein by reference.

To produce a transducer having differently polarized magnets, the magnets must be fully magnetized before assembly. Unfortunately, magnets tend to attract ferrous debris that may exist in the manufacturing environment. In addition, most magnets are formed of brittle ceramic material having potentially delicate edges that may break off, resulting in tiny particles that remain attracted. Thorough vacuuming is generally inadequate to remove all magnetically attracted particles.

If particles remain in the final assembly, they create unwanted noise during transducer operation, often at unacceptable levels. Accordingly, manufacturing must occur in a clean environment, and strict handling procedures must be employed to prevent shedding of magnet fragments. These measures increase manufacturing costs, and are not entirely effective.

Currently, inexpensive conventional magnet structures such as those employing a single doughnut magnet, as discussed above, may be fully assembled before magnetization. Special environmental and handling procedures are not required; before magnetizing, the assembly may be thoroughly and effectively vacuumed. The assembled structure is then placed in a strong magnetic field to magnetize the magnet. No further handling is necessary, and the delicate magnet is protected against damage by the surrounding structure.

Such post-assembly magnetism is difficult or impossible in transducers having multiple differently-polarized magnet structures. For example, existing two-way transducers having a cone woofer coaxially aligned with a dome tweeter generally employ separate magnet structures for the woofer and the tweeter. The need to carefully handle these pre-magnetized magnets increases the manufacturing costs as discussed above.

SUMMARY OF THE INVENTION

The primary object of this invention is to provide an improved audio transducer having a voice coil and magnet structure that may be reliably manufactured using highly automated processes.

It is a further object of the invention to provide a voice coil that is readily manufacturable of highly heat resistant material.

It is a further object of the invention that the voice coil be configured to readily radiate heat.

These objects may be satisfied by providing a transducer having a voice coil etched from a copper clad flexible sheet of printed circuit material, which is then curved to form a tube shape. The coil is etched to form the pattern of an elongated oblong spiral formed of a single trace having numerous closely spaced loops. The spiral includes two spaced-apart straight elongated paths, designated "front" and "rear" conductor paths. Each path includes a group of closely spaced loop segments. The ends of the otherwise flat sheet are connected to each other to form a tube. Consequently, current flowing through the coil at any instant will create current flow in one orbital direction through one of the paths, and in the opposite orbital direction through the other path.

To achieve useful speaker motion, the first coil path must be positioned in a radial magnetic field of a first polarity, with the second path positioned in a radial magnetic field of the opposite polarity. These fields are provided by a magnet structure having a doughnut magnet surrounding a central magnet. The doughnut magnet has a front-to-rear polarity opposite that of the central magnet. Front and rear pole pieces on each of the magnets define front and rear magnet gaps for receiving the coil, with the front and rear conductor paths positioned in the respective gaps. A doubled net force acts on the coil due to the opposite current flow through the paths and the corresponding opposite magnetic fields.

The transducer may be more easily manufactured by providing a single magnet and an adjacent iron bar spaced apart to define a gap. The bar has two edges, each positioned near one pole of the magnet to define a respective field across the gap, with the fields being oppositely polarized. An electromagnetic coil is positioned to oscillate within the gap in response to an audio signal. The transducer is assembled with an unmagnetized magnet. After assembly and thorough vacuuming, the magnet is magnetized by application of an external magnetic field.

BRIEF DESCRIPTION OF THE DRAWINGS

FIG. 11 is a cutaway isometric view of a transducer in accordance with a further embodiment of the present invention.

FIG. 12 is a cross-sectional top view taken along line 12—12 of FIG. 11.

FIG. 13 is an exploded isometric view of the ferrous bar of FIG. 11.

FIG. 14 is an isometric view of a ferrous bar having an alternate cross-section.

FIG. 15 is an isometric view of a ferrous bar having a further alternate cross-section.

FIG. 16 is a cross-sectional side view of a two-way coaxial audio transducer.

FIG. 17 is a cutaway front view of the transducer of FIG. 16.

FIG. 18 is a cutaway side view of an alternative embodiment of a two-way coaxial transducer.

DETAILED DESCRIPTION OF THE INVENTION

Figure 1:
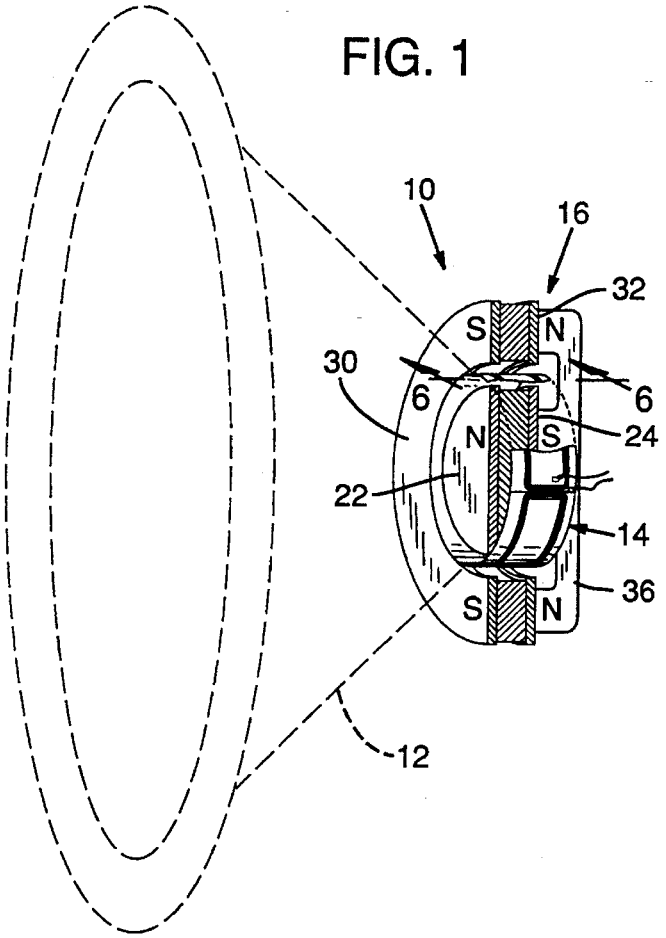
FIG. 1 is a cut-away isometric view of a transducer in accordance with a first embodiment of the present invention.

FIG. 1 illustrates a loudspeaker 10 having a cone diaphragm 12 attached to an acoustic member such as a cylindrical voice coil 14. A magnet structure 16 closely surrounds and centrally occupies the voice coil, creating magnetic fields in which the voice coil is suspended.

Figure 2:
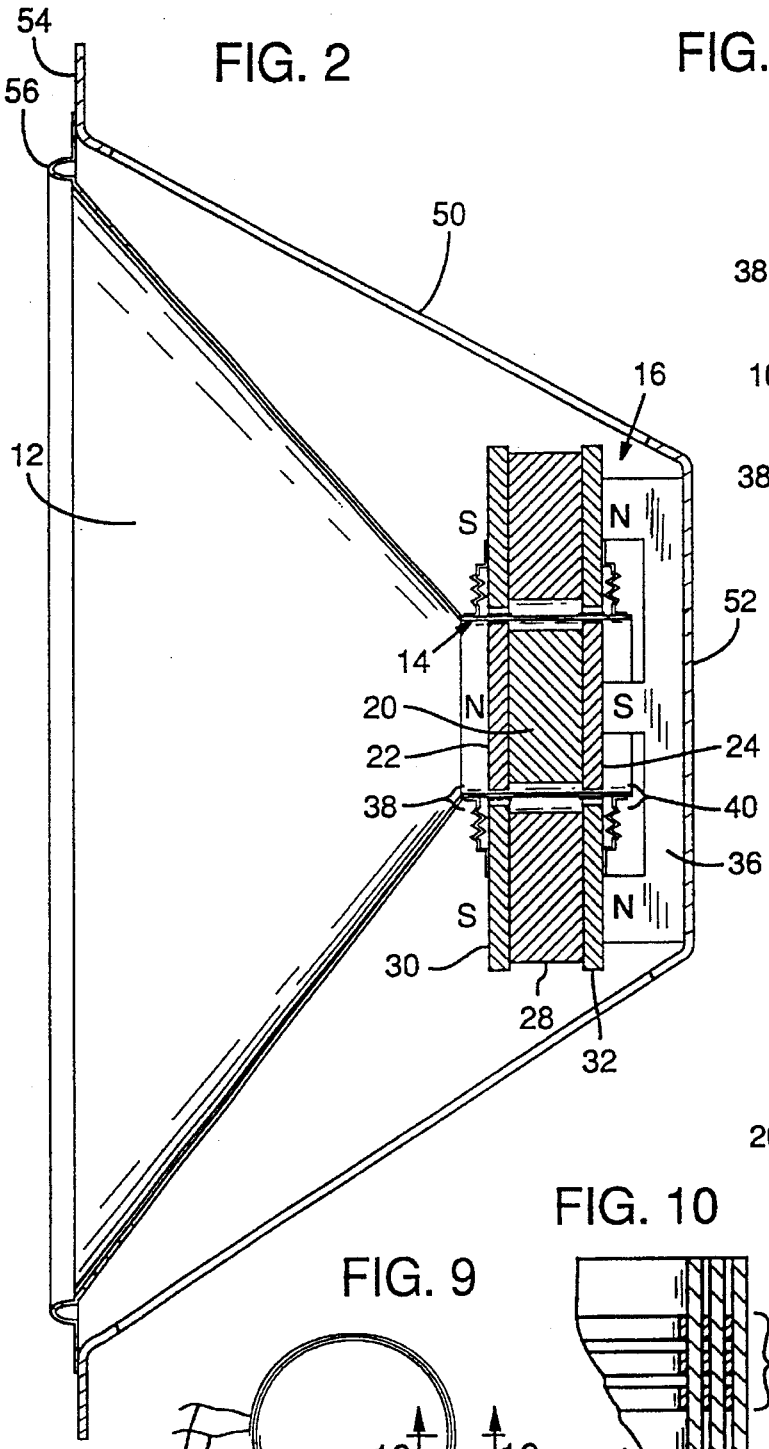
FIG. 2 is a sectional side view of the transducer of FIG. 1.

As shown in FIG. 2, the magnet structure 16 includes a central magnet element 20 having a central front pole plate 22 and a central rear pole plate 24 attached, respectively, to front and back surfaces of the central element 20. The central element has an overall cylindrical shape to fit closely within the voice coil 14 without contacting it. An annular outer magnet element 28 having an outer front pole plate 30 and an outer rear pole plate 32 closely surrounds the voice coil 14. The central magnet element 20 and outer magnet element 28 are secured at their rear sides to a non-ferrous bridge 36 so that the magnet elements generally occupy the same plane. Suitable non-ferrous materials include brass, aluminum, and plastics. Consequently, the front pole plates 22 and 30 are coplanar and define a narrow annular front magnet gap 38, and the rear pole plates 24 and 32 similarly define a corresponding rear magnet gap 40.

Figure 6:
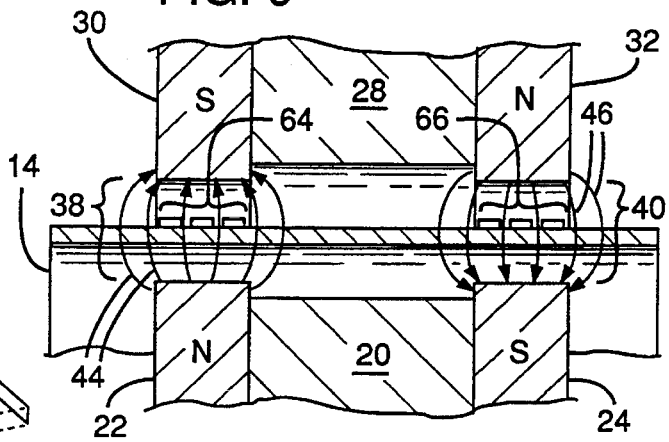
FIG. 6 is an enlarged cross sectional view of one portion of the voice coil and magnet gap of the embodiment of FIG. 1.

The central magnet element 20 and outer magnet element 28 are oppositely polarized. In the illustrated embodiment, the central front pole plate 22 and outer rear pole plate 32 are north poles, and the central rear pole plate 24 and outer front pole plate 30 are south poles. Accordingly, as shown in FIG. 6, magnetic flux flows radially outward from the central front pole plate 22 to the outer pole plate 30 along front magnetic field lines 44, which span the front magnetic gap 38. Magnet flux flows radially inward from the outer rear pole plate 32 toward the central rear pole plate 24 across the rear magnet gap 40 along rear magnetic field lines 46.

As further shown in FIG. 2, the loudspeaker 10 includes a rigid frame 50 having a rear section 52 secured to the bridge 36, and a front flange 54 attached to the front peripheral edge of the cone 12. The cone 12 includes a flexible surround 56 to permit piston-like motion to generate sound.

Figure 4:
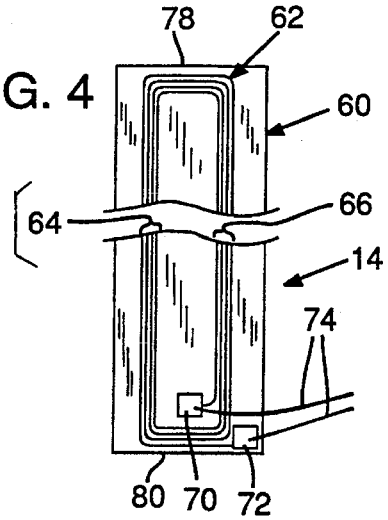
FIG. 4 is a plan view of the voice coil of FIG. 3 shown in an unassembled flat configuration.

FIG. 4 shows the voice coil 14 as a planar sheet prior to being formed to a cylindrical shape. The voice coil 14 includes an elongated rectangular substrate 60 of a thin, flexible high-temperature material such as glass-epoxy or Kapton® film (manufactured by DuPont). A conductive pattern 62 is provided on at least one face of the substrate, and preferably forms an elongated oblong spiral trace having numerous adjacent concentric loops. Although illustrated with only three or four loops, the preferred embodiment includes between four and eight loops. The pattern 62 includes a straight front path 64 running substantially the entire length of the sheet 60 and including a group of closely spaced parallel loop segments. A similar rear path 66 is spaced apart from the front path by a distance comparable to the space between the front and rear magnet pole plates. The conductive pattern 62 includes an inner contact pad 70 and an outer contact pad 72, with each pad being connected to an opposite end of the conductive spiral trace. Accordingly, with lead wires 74 connected to the respective paths, current may be passed through the conductive pattern 62. Because of the spiral configuration, current flowing at any given moment flows in opposite directions through the respective front and rear paths 64, 66 as it circulates through the pattern.

Figure 3:
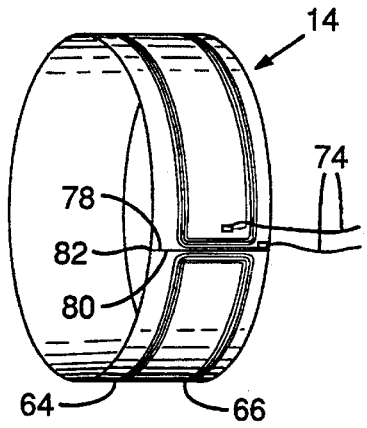
FIG. 3 is an isometric view of the voice coil of the embodiment of FIG. 1 shown in an assembled tubular configuration.

The substrate 60 terminates at first and second ends 78, 80, which are joined together at junction 82 as shown in FIG. 3 to form the assembled cylindrical coil 14. The ends are joined by attachment means (not shown) such as tape, glue, welding, or a mechanical fastener. As a consequence of the tubular shape, current flowing through the coil at any given moment will flow in contrary circular orbital directions through the respective front and rear paths 64, 66. For example, as shown in FIG. 6, when current flows "into the page" in the traces of the front path 64, it must flow "out of the page" through the traces of rear path 66.

FIG. 6 further shows that the front and rear paths 64, 66 are spaced apart by an amount generally equal to the spacing between the front plates and the rear plates of the magnet structure 16 so that the paths 64, 66 are positioned within the respective front magnet gap 38 and rear magnet gap 40.

It is apparent from FIG. 3 that the paths 64 and 66 do not completely encircle the coil 14 because the conductive pattern 62 does not cross the junction 82. The spiral pattern avoids the need for electrical connections across the junction, and provides effective operation of the coil in the magnetic fields generated by the magnet structure 16 because the nearly complete circular paths function as complete helical coils.

The voice coil 14 of the preferred embodiment is manufactured from a copper-clad sheet of flexible material. Using conventional printed circuit manufacturing techniques, the spiral pattern is etched in the copper cladding and subsequently plated with tin or coated with an oxide-inhibiting film to prevent corrosion. These manufacturing techniques are very well known and provide very uniform dimensions. The preferred embodiment is formed of material clad with one-half ounce copper foil, although a wide range of thickness may be used, depending on the application. One ounce foil may be used where lower impedance is desired. The typical trace width may be in the range of 0.003 to 0.015 inch, with 0.010 inch being preferred. Spacing between adjacent traces is ideally as narrow as possible, with 0.005 inch being preferred due to current manufacturing limitations.

Figure 5:
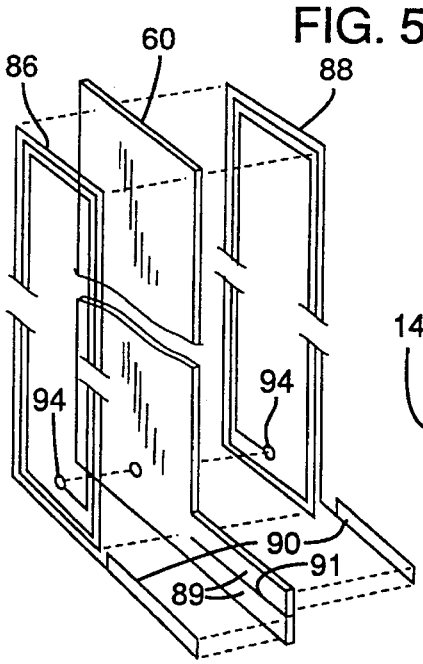
FIG. 5 is an exploded view of a two sided voice coil in a flat configuration in accordance with a second alternative embodiment of the present invention.

FIG. 5 shows an alternative embodiment double-sided coil having a first spiral trace 86 and a second spiral trace 88 on opposite sides of an alternative substrate 60' including a pair of adjacent, integral leads 89 extending perpendicularly from a long edge of the substrate 60' near one end. The outer terminus of each trace is connected to an elongated connector pad 90, and the inner ends are connected to each other via a plated conductive through-hole 94. The leads 89 form flexible extensions with ends that may be connected to fixed terminals as discussed below. A slit 91 is provided between the leads 89 to allow them to be split for independent flexing, twisting, and connection.

The spirals on each side are oriented to carry current in the same orbital direction to avoid cancelling the other's effects. This permits effectively twice as many conductive loops, which provides increased efficiency for a given power input. In addition, heat dissipation is improved because both sides may be exposed to air.

Figure 9:
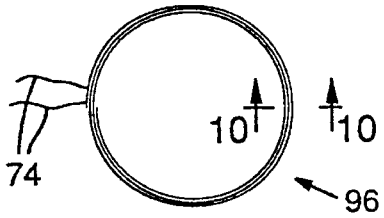
FIG. 9 is a front view of an assembled voice coil having multiple overlapping layers according to a fifth embodiment of the present invention.
Figure 10:
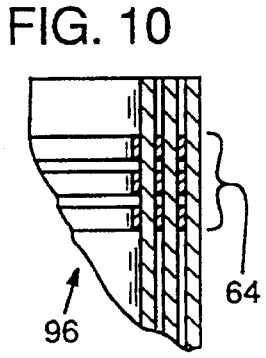
FIG. 10 is an enlarged cross sectional side view taken along line 10—10 of FIG. 9.

FIG. 9 illustrates an additional alternative embodiment voice coil 96 that may be formed from a single-sided etched sheet having a length several times the desired circumference of the finished voice coil. The elongated sheet is rolled up to form a tube having a wall thickness of several layers. FIG. 10 illustrates such an embodiment having a wall thickness of three layers with a single-sided sheet as shown. It is not necessary to provide additional insulation layers, because the conductive traces contact only the insulating substrate layer.

The single-sided, multi-layer embodiment has the advantage of improved dimensional and mechanical stability due to the inherent tendency of film to form a rigid tube when overlapped as shown. The double-sided embodiment of FIG. 5 does not lend itself to such an overlapped configuration without an intermediate insulating layer, but when used as a single layer it has the advantage of effective heat dissipation. The single-sided, non-overlapped configuration of FIG. 3 also provides effective heat dissipation, and may be used where large numbers of wire loops would not be required. To provide rigidity and stability in the non-overlapped versions such as shown in FIG. 3, a rigid disk or ring (not shown) may be inserted within the cylindrical coil to maintain a controlled circular cross section.

Figure 7:
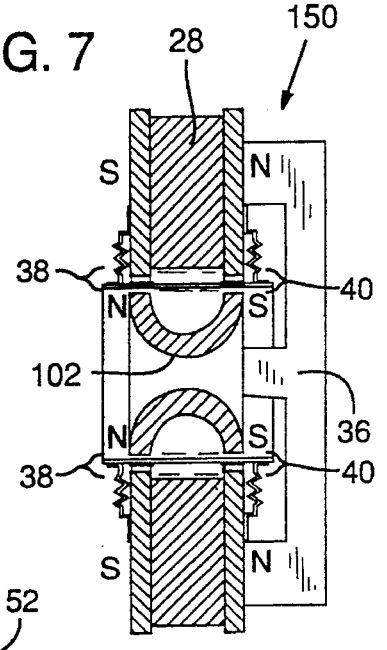
FIG. 7 is a cross sectional side view of an alternative magnet structure and coil according to a third embodiment of the present invention.
Figure 8:
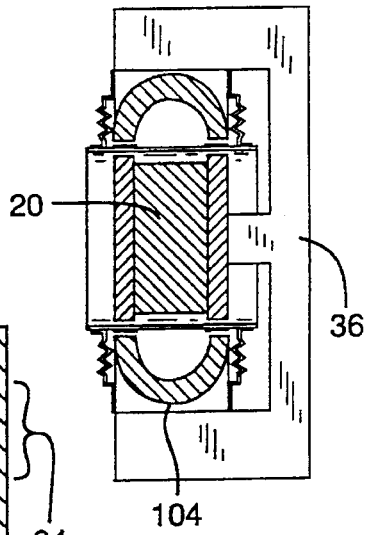
FIG. 8 is a cross sectional side view of an alternative magnet structure and coil according to a fourth embodiment of the present invention.

FIGS. 7 and 8 illustrate embodiments of the magnet structure suitable for low cost or light weight applications in which a limited strength magnetic field is adequate. In each embodiment, a magnet element is replaced by a magnetic-flux-transmitting ring formed of a ferrous material such as iron or low carbon steel. FIG. 7 shows a magnet structure 150 including the bridge 36 and outer magnet 28 of the preferred embodiment. An inner flux-transmitting ring 102 is rigidly attached to the center of the bridge. The ring 102 preferably has an outwardly facing C-shaped cross section, but may alternatively take any of a variety of forms, including a solid cylindrical plug. The outer magnet 28 magnetizes the ring 102 to create the desired magnetic fields across the magnet gaps 38 and 40.

Similarly, as shown in FIG. 8, the bridge 36 is connected to the central magnet element 20 of the type shown in the preferred embodiment. An outer flux-transmitting ring 104 having an inwardly facing C-shaped cross section is attached to the bridge. The ring 104 opposes magnetic pole plates to form the magnet gaps, thereby becoming sufficiently magnetized to create the necessary magnetic fields.

For certain unusual applications, it may be necessary to avoid any imbalance of forces acting on the coil. The portion of the voice coil nearest the junction does not contribute a driving force and therefore may need to be balanced by a comparable region halfway around the coil. This may be achieved by providing a notch (not shown) in the pole plates to provide a reduced magnetic field to reduce the driving force on the side opposite the junction. Other options include adjusting the spiral pattern so that the paths detour briefly toward the center of the substrate at a position opposite the junction, so that there is no current flowing within the magnet gaps at those detoured locations. In the applications contemplated, however, these precautions should not be necessary to achieve satisfactory performance.

It will be appreciated that while the voice coil is shown in a configuration having a circular cross section, other cross sectional profiles may be used in conjunction with magnet structures having appropriately configured magnet gaps. It is also contemplated that the invention may be employed in applications unrelated to audio transducers, including applications that currently employ linear actuators having wire wound coils for interacting with a magnetic field.

A further embodiment contemplated for applications not requiring high efficiency employs a voice coil as shown in the preferred embodiment, but with a conventional doughnut magnet structure (not shown) having only a single radial magnetic field. The coil is positioned farther forward than in the preferred embodiment, so that only the rear path is positioned in the magnet gap. The front path is positioned well forward of the magnet structure to avoid interaction between the front path and the magnetic field. The coil may be enlarged to increase the space between the front and rear paths to provide clearance. The front path traces may further be enlarged to reduce impedance.

FIG. 11 illustrates an audio transducer 110 having a flexible, figure-eight-shaped cylindrical diaphragm 112, in the manner of U.S. Pat. No. 4,903,308 and U.S. Pat. No. 5,230,021. The illustrated embodiment, however, includes only a single magnet.

As shown in FIGS. 11 AND 12, the transducer 110 includes a front frame plate 114 and a rear frame plate 116 that are spaced apart to accommodate a magnet assembly 118. The frame plates are formed of a non-ferrous, non-magnetic material such as a rigid plastic or aluminum. The magnet assembly 118 includes a single magnet 122 with spaced-apart pole plates 124 attached to the respective major surfaces of the magnet. Each pole plate is secured to the respective frame plate 114, 116.

Referring to FIGS. 11–13, the magnet assembly 118 further includes an iron bar 126 fixed to a non-ferrous, non-magnetic spacer block 128. The bar 126 and spacer block 128 are positioned opposite the magnet 122 and spaced apart therefrom to define a magnet gap 132 for receiving a coil-carrying central expanse 133 of the diaphragm 112 therebetween. The bar 126 functions in the same manner as the flux-transmitting rings 102 and 104 shown above in FIGS. 7 and 8.

The frame may include some ferrous portions, but these must be carefully designed to avoid "shorting" the magnetic "circuit." Such shorting occurs if a ferrous portion extends from a position near or touching one of the magnet poles to a position near or touching the other magnet pole or iron bar 126. If shorting occurs, the magnetic fields will be diminished. Therefore, a partially ferrous frame should have non-ferrous spacers at either the magnet or the iron bar to prevent shorting.

As shown in FIG. 13, the bar 126 includes vertical elongated end regions 134 that face the edges of the pole plates 124. Consequently, a magnetic field is formed across the gap 132 between each pole plate and each corresponding end region 134 in the manner illustrated in FIG. 6. Because the pole plates are oppositely polarized, the magnetic fields are also oppositely polarized.

Although shown with a C-shaped cross-section in the preferred embodiment of FIG. 13, with the terminal edge surfaces forming the end regions 134, the bar may function suitably in other forms. FIG. 14 shows a rectangular channel bar 126' having a flat base wall 136 and parallel side walls 138 protruding therefrom and terminating at end regions 134'. The base wall 136 is also securely attached to a spacer block opposite the pole plates 124.

FIG. 15 shows a low-cost flux transmitting plate 126" in the form of a simple rectangular iron plate. In this embodiment, the edges of the plate do not face the magnet pole plates 124; a major flat face 142 faces the pole plates and includes peripheral face regions 134" directly opposite the edges of the pole plates 124.

With the transducer 110 including only a single magnet, the magnet may be magnetized after partial or complete assembly of the transducer. Prior to magnetizing, the magnet assembly 118 is secured between the frame plates 114, 116 and the diaphragm 112 attached. The transducer is then thoroughly vacuumed to remove any magnetic, ferrous, or other particles. The transducer may then be further enclosed or packaged, after which it is subjected to a magnetic field to induce magnetism in the magnet 122.

FIGS. 16 through 18 illustrate a two-way coaxial transducer 140 related to that shown in FIG. 2 and employing the iron flux-transmitting rings similar to the embodiments shown in FIGS. 7 and 8. As in FIG. 2, the woofer cone 12 is attached to a cylindrical outer coil 14'. The outer coil 14' is received within an outer annular gap 141 defined between the periphery of an annular magnet 142 and an outer iron ring 143. Thus, the cone 12 is driven in response to a signal carried through the outer coil 14.

To provide a second sound source for two-way operation, a central tweeter dome 144 is attached to an inner voice coil 146 that is positioned within an inner annular magnet gap 150 defined between a central aperture 151 of the magnet 142 and an inner iron ring 152 positioned coaxially within the aperture 151. The inner coil 146 and the outer coil 14' are connected to separate audio signal sources, with the inner coil handling the upper frequency ranges, and the outer coil handling the lower frequency ranges of a single full-frequency-range signal. A crossover network (not shown) is generally used to split the signal into high and low frequencies.

The coils are independently suspended for free axial movement by an annularly pleated suspension element 153. The single suspension element has a central hole 154 for securely receiving the central coil 146, and has an outer edge 156 received within and attached to the outer coil 14. A raised annular adhesive strip 160 is attached at an intermediate radius on the front surface of the magnet 142, and coaxial with the central aperture 152. The adhesive strip 160 is raised above the magnet surface to provide clearance so that the suspension element does not contact the magnet during oscillation of the voice coils. The suspension element includes a flat annular region 162 at an intermediate radius corresponding to the adhesive strip, and provides the site for attachment to the strip.

The outer coil 14' preferably includes the integral leads of the FIG. 5 coil embodiment to provide simple, effective connections without the need to solder separate wires to the coil 14'. The coil may be oriented so that the leads 89 extend from the front or rear edge of the coil, with the rear being preferred in this embodiment. Each flexible lead 89 is curved outward toward a terminal 163, to which it is electrically connected by clamping or soldering. Alternatively, each lead may be mechanically clamped to a nonconductive terminal so that it is accessible for direct connection to a wire (not shown) that connects to an electrical signal source. The inner coil 146 may include a similar integral lead connection.

Holes or channels (not shown) formed in the frame 50 and bridge 36 provide access and clearance to permit the leads 89 to flex as the coil oscillates.

Although shown in a preferred embodiment to facilitate manufacturability, the inner ring 152 and outer ring 141 may have a C-shaped or channel-shaped cross-section analogous to those shown in FIGS. 13 and 14. The inner ring 152 may also take the form of a solid ferrous cylinder. Alternatively, separate magnets may be substituted for the iron rings, with the separate magnets having opposite polarity from that of the illustrated magnet 142, much as shown in FIG. 2.

FIG. 18 shows an alternative embodiment transducer 166 having an outer coil 14' that extends axially well forward of the magnet structure. A modified cone 12' is attached at an intermediate radius to the front edge of the coil and extends generally inwardly therefrom toward the tweeter dome 144 as well as outward toward the surround 56 (shown in FIG. 16). The cone 12' terminates inwardly at a central aperture 168 that is slightly larger than the diameter of the dome 144 to provide clearance as the dome and cone independently oscillate. This additional inner rigid portion of the cone provides a larger active area for a given overall diameter than does the embodiment of FIG. 16. Consequently, efficiency is increased.

The invention may further comprise an audio transducer comprising a frame, a magnet attached to the frame, a first movable electromagnetic coil positioned adjacent the magnet and movable relatively thereto, a second movable electromagnetic coil positioned adjacent the magnet and movable relatively therewith and independently of the first coil, a first acoustic element attached to the first coil for generating sound in response to motion of the first coil, and a second acoustic element attached to the second coil for generating sound in response to motion of the second coil.

Having illustrated and described the principles of my invention by what is presently a preferred embodiment, it should by apparent to those persons skilled in the art that the illustrated embodiment may be modified without departing from such principles. I claim that my invention, not only the illustrated embodiment, but all such modifications, variations, and equivalents thereof fall within the true spirit and scope of the following claims.

I claim:

1. A two-way audio transducer comprising:

a non-magnetizable bridge;

a magnet connected to the bridge, the magnet having first and second magnet poles;

a first ferromagnetic element connected to the bridge adjacent the magnet to define a first magnet gap between the magnet and the first ferromagnetic element traversed by magnetic flux;

a second ferromagnetic element connected to the bridge adjacent the magnet to define a second magnet gap between the magnet and the second ferromagnetic element, the second magnet gap being traversed by magnetic flux passing between the first magnet pole and the second ferromagnetic element, and between the second magnetic pole and the second ferromagnetic element;

a first electrically conductive coil received within the first magnet gap;

a second electrically conductive coil independent of the first coil and received within the second magnet gap, the second coil being formed as a plurality of nested, elonqated concentric loops serially connected to one another, the second coil being configured as a cylindrical tube having a cylinder axis, a first end and a second end such that each loop has a first loop portion proximate the first end of the tube and adapted to conduct an electrical signal from a source circumferentially in a first direction at least partially around the tube, and a second loop portion distal from the first end of the tube and adapted to conduct the electrical signal from the source circumferentially in a second direction opposite the first direction at least partially around the tube so as to cause the second coil to move, whenever electrical current is passing through the second coil, along the cylinder axis relative to the second magnet gap;

a first acoustic element connected to the first coil; and a second acoustic element connected to the second coil, the acoustic elements being operable independently of each other.

2. The transducer of claim 1 wherein the magnet is an annular ring.

3. The transducer of claim 2 wherein the first ferromagnetic element has a circular profile and is coaxially received within the magnet.

4. The transducer of claim 1 wherein the second ferromagnetic element surrounds the magnet.

5. The transducer of claim 1 wherein the first coil and second coil are coaxially aligned cylinders.

6. The transducer of claim 1 wherein the first acoustic element is a dome.

7. The transducer of claim 1 wherein the second acoustic element is a cone.

8. The transducer of claim 1 wherein at least one of the first coil and the second coil is formed from a planar sheet having opposed end portions, the sheet being curved such that the end portions contact each other.

* * * * *